United States Patent [19]

Haile

[11] Patent Number: 4,490,592

[45] Date of Patent: Dec. 25, 1984

[54] MAGNETIC FLOW SWITCH

[76] Inventor: Ernest Haile, 30 Cadwallader Ter., Trenton, N.J. 08618

[21] Appl. No.: 408,166

[22] Filed: Jun. 4, 1982

[51] Int. Cl.[3] ..... H01H 35/40

[52] U.S. Cl. ..... 200/81.9 M

[58] Field of Search ..... 200/81.9 M, 81.9 HG, 200/82 E, 84 C; 335/205, 207; 340/610, 611

[56] References Cited

U.S. PATENT DOCUMENTS

| | | | |
|---|---|---|---|
| 1,962,795 | 6/1934 | Walker | 361/178 |
| 2,988,916 | 6/1961 | Waugh | 200/81.9 M X |
| 3,327,079 | 6/1967 | Widl | 200/82 R |
| 3,446,986 | 5/1969 | Cox | 307/118 |
| 3,564,175 | 2/1971 | Cooper | 200/82 E |
| 3,749,864 | 7/1973 | Tice | 200/81.9 M |
| 3,766,779 | 10/1973 | Hoffman | 73/228 |
| 4,071,725 | 1/1978 | Smith et al. | 200/82 E |
| 4,081,635 | 3/1978 | Moore | 200/81.9 M |
| 4,085,336 | 4/1978 | Miles | 200/81.9 M X |
| 4,168,413 | 9/1979 | Halpine | 200/81.9 M X |
| 4,181,835 | 1/1980 | Stadler et al. | 340/610 X |
| 4,291,761 | 9/1981 | Watson | 335/207 X |

FOREIGN PATENT DOCUMENTS

| | | | |
|---|---|---|---|
| 1381255 | 1/1975 | United Kingdom | 200/81.9 M |

*Primary Examiner*—J. R. Scott

*Attorney, Agent, or Firm*—Harvey B. Jacobson

[57] ABSTRACT

A magnet is mounted upon a conduit and moves radially thereof between opposite extreme positions in which it actuates a reed switch to an open or closed position. The magnet is urged from a normal position by movement of a skeletal cylinder within the flow passage to a position in which it causes the magnet to shift itself from one to the other of its respective positions. The skeletal cylinder is shifted to its magnet-attracting position by fluid flow (for example, gas, air or steam) through the passage. Means is provided to permit selection of the flow rate required for shifting of the skeletal cylinder to the position in which it acts upon the magnet.

16 Claims, 16 Drawing Figures

MAGNETIC FLOW SWITCH

BACKGROUND OF THE INVENTION

1. Field of the Invention

The present invention relates to flow responsive devices, and in a more particular sense, to switches that are magnetically controlled, and are actuated as a response to fluid pressure within an adjacent conduit.

2. Description of the Prior Art

The general concept of having a magnetically controlled switch responsive to a flow condition within a conduit is known. In U.S. Pat. No. 3,327,079 issued to Widl it is proposed, by way of example, to utilize a permanent magnet bodily shifted by the pressure fluid to actuate a reed switch. Other patents showing the concept of magnets (though within the conduit itself) are U.S. Pat. Nos. 3,446,986 to Cox and 4,181,835 to Stadlet et al., both of which disclose magnets movable by a pressure fluid to act upon a switch mounted adjacent the conduit.

In U.S. Pat. Nos. 3,766,779 to Hoffman and 4,071,725 to Smith et al., it is proposed to utilize magnetically attractable pistons movable within a conduit according to the changing condition of fluid flow therein. In U.S. Pat. No. 4,071,725 the piston moves to a position adjacent a magnet to shift the magnet and in this way to operate a switch. In U.S. Pat. No. 3,766,779 a permanent magnet is provided, affixed to the piston to act upon a slave magnet.

While in many instances the switches disclosed in the mentioned patents are operable efficiently for their intended purposes, there remains room for improvement, in that it is desirable to swiftly and easily adjust the relative positions of the components of the device, so as to correspondingly select, in an adjustable fashion, the point at which the adjacent switch will close or open, as the case may be. And, it is also desirable to provide, in a device of this type, components that can be readily modified or interchanged, either at installation or thereafter, in such a manner as to adjust the fluid pressure required to actuate the switch.

SUMMARY OF THE INVENTION

Summarized briefly, the invention includes a conduit having therein a skeletal cylindrical element adapted to be moved from a rest position responsive to the presence of a predetermined quantum of fluid pressure therein. When moved from its rest position, the skeletal cylinder is adapted to actuate a magnet mounted exteriorly of the fluid passage, so that the magnet shifts position and operates an adjacent reed switch either to a closed or to an open position, according to the installation requirements.

The movable magnet, and its associated reed switch, are adjustable bodily upon the fluid passage, and in this way one is enabled to select in an adjustable fashion the extent of cylinder movement required to attract the magnet from its rest position. Further, in at least one form of the invention, it is also possible to select the amount of fluid pressure required to operate the internal skeletal cylinder to a magnet-attracting position. In making the desired adjustments, one cannot only adjust the external magnet bodily axially of the passage, but also, separately or in combination with this adjustment one can readily interchange the internal components, so as to cause them to be more responsive or less responsive to a predetermined amount of thrust exerted thereon, whichever is desired. Still further, in at least one form of the invention, it is possible to use an external magnet to act as a means for restraining the movement of the internal skeletal cylinder until pressure builds up to a predetermined amount within the fluid passage.

BRIEF DESCRIPTION OF THE DRAWINGS

While the invention is particularly pointed out and distinctly claimed in the concluding portions herein, a preferred embodiment is set forth in the folllowing detailed description which may be best understood when read in connection with the accompanying drawings, in which:

DETAILED DESCRIPTION OF THE PREFERRED EMBODIMENT

Figure 2:
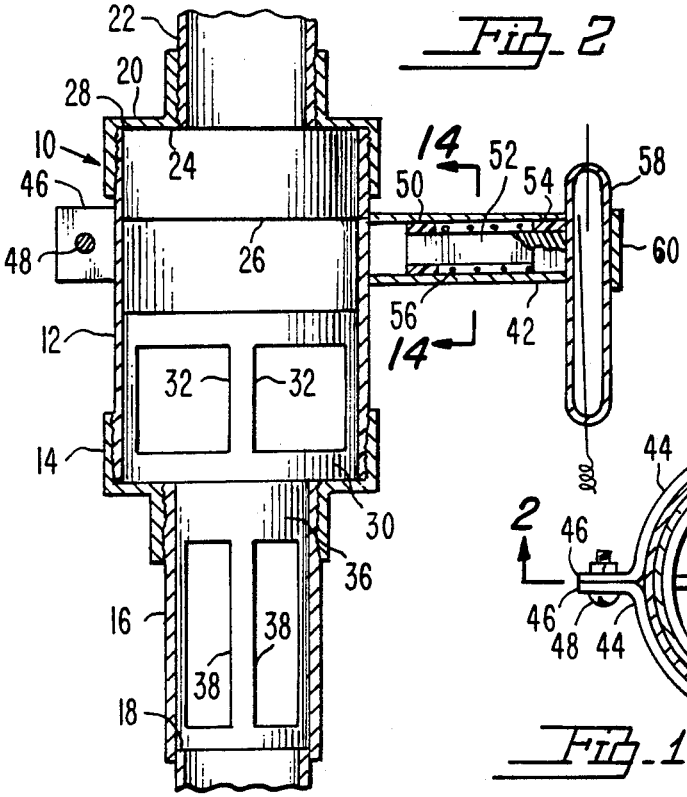
FIG. 2 is a longitudinal sectional view through the device, substantially on line 2—2 of FIG. 1, with the several components being illustrated in their rest or inoperative positions, with no fluid pressure exerted thereon.

Referring to the drawings in detail, in the form of the invention shown in FIGS. 1–4 the magnetic flow switch has been generally designated 10, and includes a cylindrical, constant diameter body 12 one end of which is externally threaded to receive an internally threaded connecting fitting 14, the larger end of which is secured to the body 12. The connecting fitting 14 has a small diameter end internally threaded for engagement with the external threads of a tubular member of pipe section 16. Member 16, at a location spaced axially thereof from the fitting 14, is stepped down to provide an internal shoulder 18.

At the other end of the body 12, shown as the upper end in the drawings, there is provided another connecting fitter 20 of the reducing type, threadedly engaged with the body, and having a small diameter end internally threaded to receive the external threads of a tubular member of pipe section 22.

From the description so far provided, it will be apparent that the device can be mounted at any selected location within a length or reach of pipe or tubing, so that fluid, whether it be gaseous or liquid, can actuate the switch during its passage through the piping.

The provision of the reducer-type of fitting 20 defines an internal shoulder 24 at one end of the body 12, and mounted against said shoulder is a skeletal cylindrical stop sleeve 26, one end of which is flared as at 28 so as to permit said stop sleeve to be tightly gripped and fixedly mounted within the body 12, by engagement of the flared portion thereof between the connecting fitting 20 and the adjacent extremity of the body 12.

Figure 3:
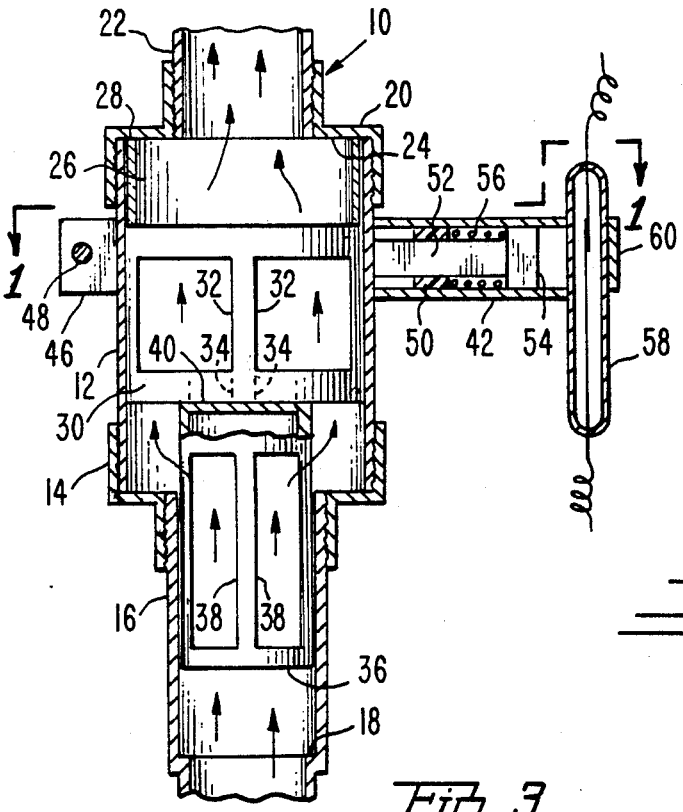
FIG. 3 is a view similar to FIG. 2 in which fluid passing through the conduit has exerted pressure or thrust upon the internal components, actuating the internal skeletal cylinder to a magnet-attracting position for permitting an external reed switch to move to a closed position from the normally open position shown in FIG. 2.
Figure 4:
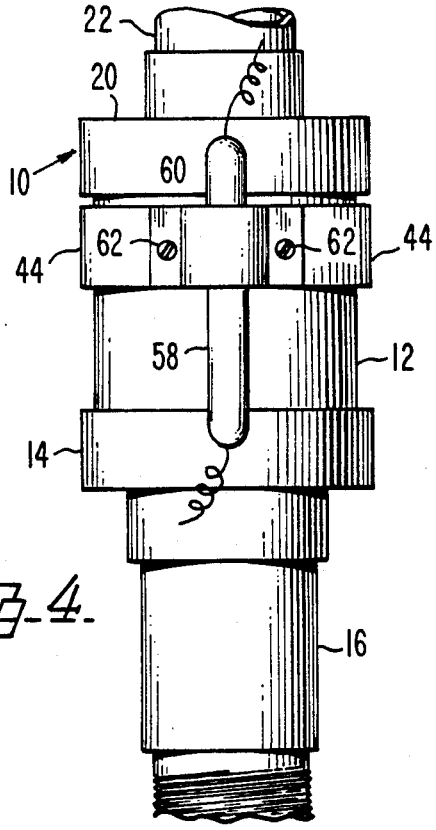
FIG. 4 is an elevational view of the device as seen from the right of FIG. 3.
Figure 8:
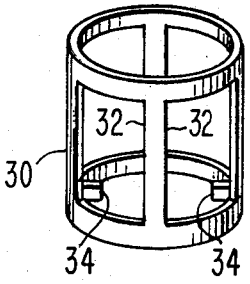
FIG. 8 is a perspective view of the internal skeletal cylinder used in the form of the invention illustrated in FIGS. 1-4, shown per se.

Freely movable within the body 12 is a skeletal cylinder 30, both ends of which are formed open, said cylinder having large openings or apertures 32 formed by rings and arms. The apertures are closely spaced circumferentially thereof. The end of the skeletal cylinder disclosed as the lower end in FIGS. 2 and 3 is formed within internal, radially inwardly extending lugs 34 (see FIG. 8). In the illustrated embodiment, four such lugs are provided, angularly spaced 90° apart within the skeletal cylinder 30.

Used in association with the skeletal cylinder 30 is a plunger 36, sliding freely within the tube or pipe sections 16. Plunger 36 normally is at rest upon the internal shoulder 18, as shown in FIG. 2, when there is no fluid flowing within the passage. The plunger, at one end, has a closed head 40 (FIG. 3), disposed adjacent the end of the skeletal cylinder 30 having the lugs 34. As a result, the lugs project inwardly radially or the skeletal cylinder 30 to an extent sufficient for them to be engaged by the plunger 40, whenever the plunger 40 is shifted axially from the normal rest position thereof shown in FIG. 2, to the advanced position shown in FIG. 3.

In accordance with the invention, the plunger 36, for the greatest part of its length, has a plurality of elongated openings 38 closely spaced circumferentially thereof and extending longitudinally of the sidewall of the plunger.

The plunger 36, at the end thereof remote from the head 40, is formed wholly open for the free passage of fluid into the plunger.

Figure 1:
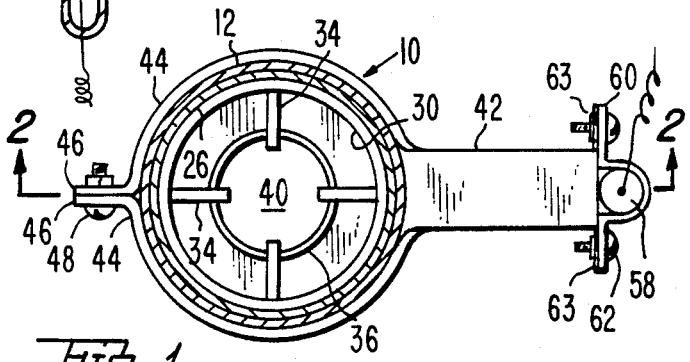
FIG. 1 is a transverse sectional view through a magnetic flow switch according to the present invention, substantially on line 1—1 of FIG. 3.

In accordance with the invention, a reed switch and magnet assembly is mounted upon the body 12 exteriorly thereof, and includes an elongated housing 42 of square cross-section (see FIGS. 5 and 14) extending radially outwardly from the body 12 intermediate the opposite ends of the body. Housing 42 is integrally formed, at its inner end, with oppositely outwardly extending clamping straps 44, which extend around opposite sides of the body as shown in FIG. 1, and are formed with ears 46 at their distal ends, receiving a connecting screw and nut 48.

It will be noted at this time that by loosening the screw 48, one can bodily adjust the entire magnet and switch assembly longitudinally of the body 12, a feature which has certain desirable characteristics as will be hereinafter noted.

In any event, when the screw 48 is tightened, to draw the ears 46 together, the strips 44 clampingly grip the body 12, to mount the housing 42 thereon.

Figure 14:
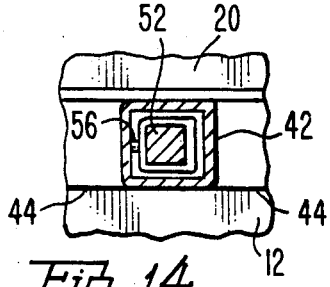
FIG. 14 is a detail sectional view on line 14—14 of FIG. 2.

Within the housing, in closely spaced relation to the inner end thereof, there is provided a guide sleeve 50 preferably of a plastic material, in which there is slidably mounted a bar magnet 52. At the outer end of the bar magnet 52, a similar sleeve 54 is secured to the magnet, to provide a head thereon, and interposed between the sleeves 50, 54 is a compression coil spring 56 having square convolutions as shown in FIG. 14.

The outer end of the housing 42 is formed open, and abutting against said outer end is the glass envelope of a reed switch 58. The reed switch 58 is clamped to the outer end of the housing 42, through the provision of a clamping strip 60 (see FIG. 4), having projections at opposite sides thereof receiving screws 62 that extend through apertures provided in laterally outwardly extending ears 63 (see FIG. 1) formed upon the outer end of the housing 42. In this way the reed switch is fixedly clamped to the outer end of the housing 42.

In use of the form of the invention shown in FIGS. 1–4, when there is no fluid passing through the pipe sections and body 12, the parts are at rest as shown in FIG. 2. This form of the invention is particularly well suited for a vertical mounting, with the pipe section 22 being the upper tubular portion and the section 16 being the lower portion. By the force of gravity, skeletal cylinder 30 comes to rest against internal shoulder 65, defined by the reducing fitting 14. Meanwhile, the upper end of the plunger 36 is at this time in contact with the inwardly extending lugs of the skeletal cylinder and its lower end is at this time seated upon internal shoulder 18 of pipe section 16.

Spring 56, being free to expand, urges bar magnet 52 radailly outwardly from the body 12, to the position thereof shown in FIG. 2. In this position of the bar magnet, it attracts the movable arm of the reed switch, so that the reed switch is in a normal, open position.

If it be now assumed that fluid is flowing through the device under pressure, as shown by the direction arrows in FIG. 3, the fluid will initially bear against the closed head 40, and this will cause the plunger 36 to be shifted axially from the position thereof shown in FIG. 2, toward the position shown in FIG. 3. As the plunger 36 moves away from the shoulder 18, fluid will begin to flow through the openings 38.

The fluid pressure can be brought up to the point where it will shift the plunger fully to the position shown in FIG. 3. As the plunger moves to this position, it is in contact with the lower end of the skeletal cylinder 30, bearing against the lugs 34 thereof. As a result, the skeletal cylinder 30 is carried upwardly with the plunger, to the position shown in FIG. 3, and will ultimately come abreast of the magnet 52.

The skeletal cylinder 30 is of a magnetically attractable material, and as a result, exerts a force upon the magnet 52 tending to shift the magnet radially inwardly of body 12, to the FIG. 3 position thereof, against the restraint of the spring 56.

As the magnet moves away from the reed switch, it no longer exerts a force upon the movable switch arm tending to hold that arm in open position. Accordingly, the arm of the switch, by reason of an inherent spring action therein, shifts to the position shown in FIG. 3, wherein it engages the upper switch arm, and closes a circuit through the reed switch.

It will be understood in this regard that in many installations, it may be desired that the reed switch 58 be normally closed, in which event the bar magnet 52 when in its outer position shown in FIG. 2 would attract the movable switch arm to a position in which it closes the switch 58, rather than keep it in open position. In these circumstances, the device is used to open an electrical circuit responsive to the flow through the conduit, rather than close the circuit as illustrated by way of example in FIGS. 1–4. It is mainly important, in understanding the disclosure, to keep in mind that the skeletal cylinder 30, when moved responsive to the passage of fluid through the conduit, acts upon the bar magnet to shift the same from one to the other extreme position thereof to change the condition of the reed switch from "on" to "off" or vice versa, whichever is desired.

Figure 12:
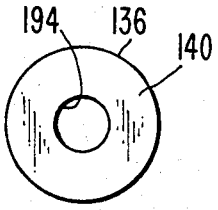
FIG. 12 is a top plan view of a plunger used as a modification of the plunger illustrated in FIGS. 2 and 3.
Figure 13:
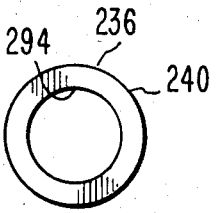
FIG. 13 is a top plan view of another form of plunger that can be used in place of the one shown in FIGS. 2 and 3.
Figure 15:
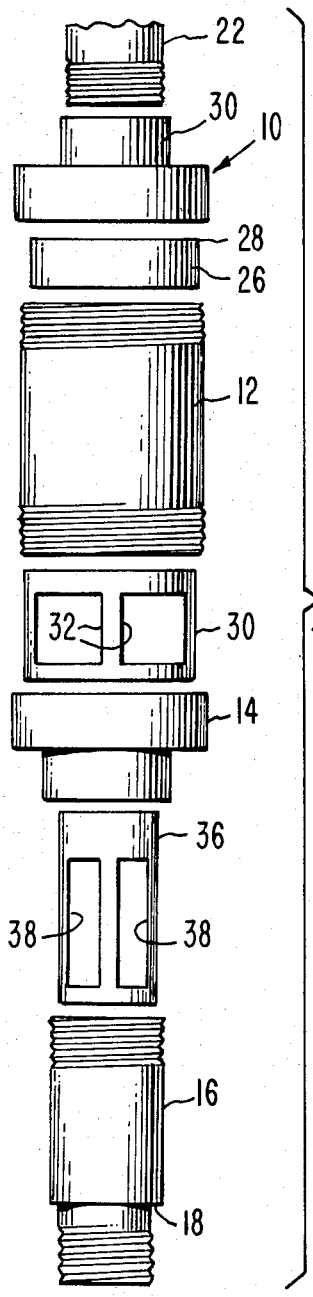
FIGS. 15 and 16 are exploded side elevational views of the forms of the invention illustrated in FIGS. 1 and 5 respectively.
Figure 16:
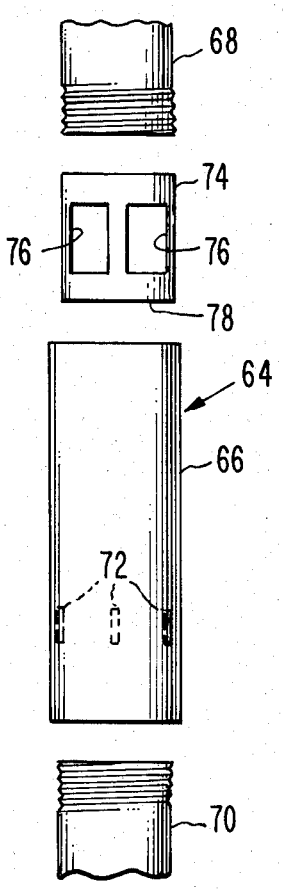

Referring now to FIGS. 12 and 13, it may be desired to adjust the amount of fluid pressure required to shift the skeletal cylinder 30 to its FIG. 3 position. The arrangement shown in FIG. 3 causes the skeletal cylinder 30 to move to the FIG. 3 position with a relatively low fluid pressure. In FIG. 12, however, instead of using a completely closed head 40 on plunger 36, the plunger 136 may have a head 140 in which is formed a center opening 194. Center opening 194 thus permits fluid to escape therethrough, and as a result, a higher amount of fluid pressure is required to bias the plunger 36 from its FIG. 2 to its FIG. 3 position, than is needed when the head 40 is fully closed as in FIG. 3.

In FIG. 13, a still greater amount of fluid pressure is required. In this form of the invention, the plunger 236 has a head 240 formed with a large center opening 294. As a result, even more fluid can escape through the plunger, and consequently, even a higher amount of fluid pressure is required in order to bias the plunger from its rest position shown in FIG. 2 to its fully actuated position illustrated in FIG. 3.

In the form of the invention shown in FIGS. 1–4, it is also possible to make adjustments by bodily shifting the magnetic switch assembly longitudinally of the body 12 to a selected location. At the location shown in FIGS. 2 and 3, full movement of the skeletal cylinder 30 from its FIG. 2 rest position to its FIG. 3 operative position is required before the magnet 52 is attracted. If, however, one so desires, one can shift the magnet and reed switch assembly downwardly from the FIG. 2 position, closer to the rest position of the skeletal cylinder 30. As a result, when the skeletal cylinder 30 is moved upwardly, less upward movement thereof is required before the bar magnet is shifted, than is true in the illustrated example. In this way, one can adjust the device so as to cause the reed switch condition to change more rapidly, after the onset of fluid flow through the conduit. Further, it is also true that the switch condition can be made more sensitive to fluid pressure, that is, in the form of the invention as shown in FIGS. 1–4 a relatively small amount of fluid pressure can swiftly actuate the reed switch, if this be desired in a particular installation.

Figure 5:
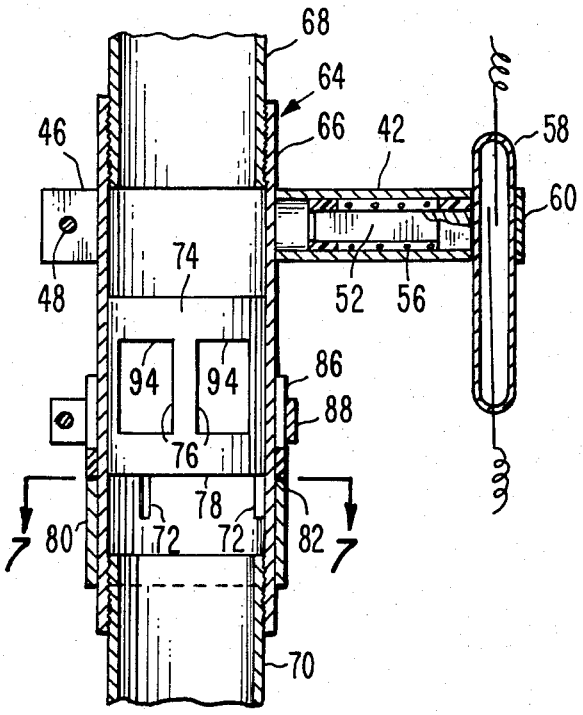
FIG. 5 is a longitudinal sectional view through a modified form, with the parts in their rest positions, without the exertion of fluid pressure thereon.
Figure 6:
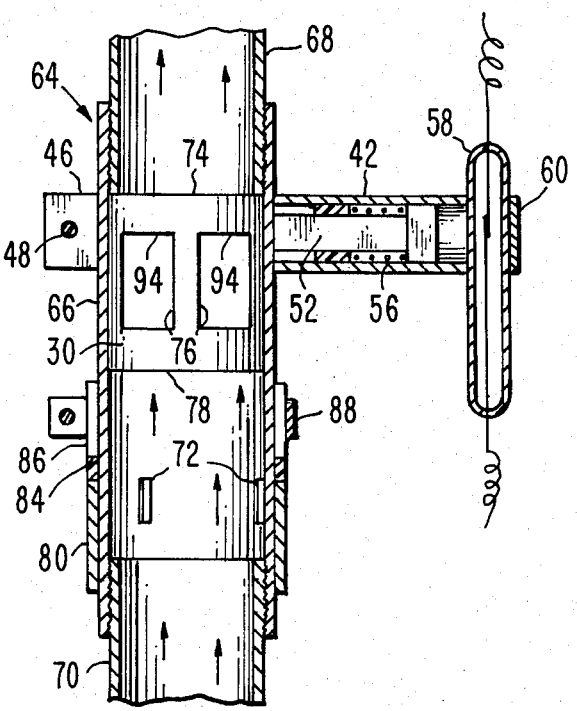
FIG. 6 is a view similar to FIG. 5 in which fluid flowing through the conduit has exerted thrust upon the skeletal cylinder and has actuated it to a position in which it attracts the magnet for operating the reed switch from a normally open to a closed position.
Figure 7:
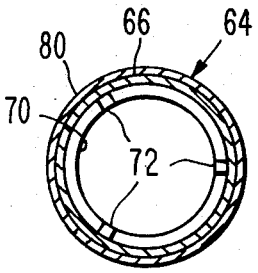
FIG. 7 is a transverse sectional view substantially on line 7—7 of FIG. 5.

In the form of the invention shown in FIGS. 5 and 6, the device has been generally designated 64, and includes an elongated body 66, internally threaded at its opposite ends for connection to pipe sections 68, 70 respectively. In this form of the invention, internal stop lugs 72 are formed on the body, angularly spaced equal distances apart about the inner surface of the body.

In this form the movable skeletal cylinder has been designated 74, and has angularly spaced, large apertures 76 formed therein, similarly to the skeletal cylinder 30. In this form of the invention, however, it is not necessary to provide the radially inwardly extending lugs 34, because the skeletal cylinder rest directly upon the lugs 72 of the body 66. In FIG. 5, thus, the movable skeletal cylinder is shown in its normal or rest position, in which it is spaced longitudinally of the body from the magnet and switch assembly. The magnet and switch assembly is identical to that used in the first form of the invention, and is secured to the body 66 at any desired location longitudinally thereof.

Figure 9:
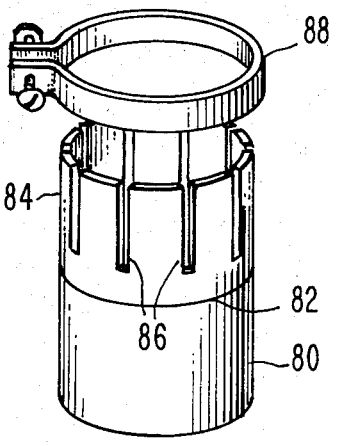
FIG. 9 is an exploded perspective view of an external magnet assembly used in the form of the invention shown in FIGS. 5 and 6.
Figure 10:
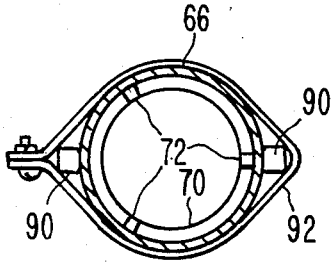
FIG. 10 is a transverse sectional view on the same cutting plane as FIG. 7, showing the device of FIG. 5 equipped with external bar magnets, rather than the cylindrical external magnet shown in FIG. 9.
Figure 11:
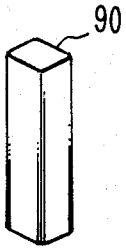
FIG. 11 is a perspective view showing one of the bar magnets used in the form of the invention illustrated in FIG. 10.

In this form of the invention, it is proposed to restrain the skeletal cylinder from movement from its rest position, through the provision of an external magnet. In FIG. 5 the external magnet is designated 80, and is of sleeve-like form (see FIG. 9, wherein the external magnet is illustrated per se). Magnet 80 is bonded at 82 to a magnet-retaining sleeve 84, having a plurality of closely spaced, longitudinal slots 86 to permit the sleeve to be positioned with maximum facility over the body 66. When the sleeve 84 has been shifted longitudinally of the body to the desired location, as for example to the location shown in FIG. 5, a clamping ring 88 is utilized, to secure the sleeve 84 tightly to the body 66. The ring, when drawn tight, is adapted to force the tongues defined by the several slots 86, inwardly against the surface of the body 66 into tight, gripping engagement therewith.

In this form of the invention, it is not essential that the device be mounted vertically. For example, if the device were mounted horizontally, the magnet 80 would exert a force upon the skeletal cylinder 74 sufficient to hold it against the lugs 72 whenever there is no flow through the passage, or whenever the flow through the passage is insufficient to move the skeletal cylinder 74 away from the lugs 72 to the use position thereof shown in FIG. 6.

In this form of the invention, no plunger is required. Instead, the skeletal cylinder 74 itself receives the thrust of the pressure fluid, with the fluid exerting pressure against the end 78 of skeletal cylinder 74, said end 78 providing a thrust surface receiving the pressure and disposed directly perpendicularly to the line along which the pressure is exerted. Also, the opening 76, surfaces 94 thereof shown in FIGS. 5 and 6 constitute additional thrust surfaces receiving the pressure exerted thereagainst by the fluid passing through the conduit.

In these circumstances, it will be understood that whenever fluid passing through the conduit exerts a predetermined amount of pressure against the skeletal cylinder 74, the fluid will cause the skeletal cylinder 74 to overcome the pull exerted thereupon by the external magnet 80, and the skeletal cylinder will now thus be free to be moved longitudinally of the body 66, as for example to the FIG. 6 position thereof. In this position, it attracts the magnet 52, so that the magnet 52 is moved to its opposite extreme position from its normal rest position shown in FIG. 5. In turn, this operates the reed switch to its opposite switch condition, whether it be "on" or "off", according to the needs of the particular installation. In the illustrated example, the switch is normally open, and thus when the magnet 52 is moved radially inwardly when attracted by the skeletal cylinder 74, the loss of magnetic force upon the movable arm of the switch 58 will permit the switch 58 to revert to a closed position, for the passage of electrical current therethrough.

Additionally, still further fine adjustment can be provided by bodily adjustment of the external magnet 80 along the length of the body, relative to the rest position of the skeletal cylinder 74. If, for example, the magnet 80 were bodily adjusted in a direction toward the magnet and switch assembly, the force exerted by the magnet 80 upon the skeletal cylinder 74 would be increased and this would require higher fluid pressure before the skeletal cylinder 74 is free of the magnetic force exerted thereon by the external magnet 80.

In both forms of the invention, the adjustments can be made without difficulty, and can be speedily affected, permitting adjustments at the installation site, where the flow conditions can be inspected and accurately checked. Further adjustments can also be made in situ, from time-to-time, to whatever extent is deemed necessary.

A skeletal cylinder has been referred to throughout this description. The skeletal cylinder, as illustrated in the figures, consists of spaced rings interconnected by circumferentially spaced arms. It has many advantages over a cylinder having solid, unbroken walls. For example, since the skeletal cylinder has apertures with large open areas, foreign matter can escape and the skeletal cylinder would be less likely to become clogged up and inoperative. Also, when mounted in a vertical position and relying on gravity to return the skeletal cylinder and plunger to the rest position the weight of the same may be greatly less than the weight of a cylinder and plunger. Since the weight would be less it would take less pressure to force the components up, thereby causing the switch to be actuated at a lower pressure.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. A magnetic flow switch comprising:

(a) a pressure fluid conduit;

(b) a skeletal cylinder of a magnetically attractive material comprising ring portions connected by arms defining openings therebetween, the cylinder being slidable within said conduit and adapted to be slidably shifted therein from a rest position to a use position by pressure fluid flowing within the conduit; and (c) a magnet and switch assembly mounted on the conduit and including a magnet attracted by the skeletal cylinder when the skeletal cylinder reaches its use position, and an electrical switch actuated responsive to the attraction of said magnet by the skeletal cylinder.

2. A magnetic flow switch as in claim 1 wherein the magnet and switch assembly are bodily adjustable upon the conduit to selected positions relative to the rest position of the cylinder.

3. A magnetic flow switch as in claim 2 wherein the magnet and switch assembly includes a housing in which the magnet is slidably mounted for movement radially of the conduit.

4. A magnetic flow switch as in claim 3 wherein the magnet and switch assembly further includes a compression spring within the housing normally biasing the magnet radially outwardly from the conduit.

5. A magnetic flow switch as in claim 4 wherein the electrical switch is a reed switch mounted upon the radially outer end of the housing.

6. A magnetic flow switch as in claim 5 wherein the reed switch includes a movable arm attracted by the magnet when the magnet is spring biased to its outer position, said magnet when attracted by the skeletal cylinder moving to a position in which its magnetic force upon the movable arm of the switch is dissipated.

7. A magnetic flow switch as in claim 3 wherein the magnet and switch assembly further includes clamping arms extending around the conduit and secured to the housing, said clamping arms being bodily shiftable longitudinally of the conduit for securing the housing to the conduit in selected positions longitudinally of the conduit relative to the rest position of the skeletal cylinder.

8. A magnetic flow switch as in claim 1, further including a plunger within the conduit against which pressure is exerted by fluid passing through the conduit, said plunger being shiftable within the conduit by the pressure of said fluid flow, to engage the skeletal cylinder and bias the skeletal cylinder to its use position.

9. A magnetic flow switch as in claim 8 wherein the plunger includes a head arranged transversely to the fluid flow for receiving the thrust of said flow.

10. A magnetic flow switch as in claim 9 wherein said head is apertured for increasing the quantum of the pressure required to shift the plunger.

11. A magnetic flow switch comprising:

(a) a pressure fluid conduit;

(b) a skeletal cylinder of a magnetically attractive material comprising ring portions connected by arms defining openings therebetween, the cylinder being slidable within said conduit and adapted to be slidably shifted therein from a rest position to a use position by pressure fluid flowing within the conduit; and (c) a magnet and switch assembly mounted on the conduit and including a magnet attracted by the skeletal cylinder when the skeletal cylinder reaches its use position, and an electrical switch actuated responsive to the attraction of said magnet by the skeletal cylinder, wherein the skeletal cylinder includes thrust surfaces against which the pressure exerted by the fluid flow is directed for shifting the skeletal cylinder from its rest to its use position.

12. A magnetic flow switch comprising:

(a) a pressure fluid conduit;

(b) a skeletal cylinder of a magnetically attractive material comprising ring portions connected by arms defining openings therebetween, the cylinder being slidable within said conduit and adapted to be slidably shifted therein from a rest position to a use position by pressure fluid flowing within the conduit; and (c) a magnet and switch assembly mounted on the conduit and including a magnet attracted by the skeletal cylinder when the skeletal cylinder reaches its use position, and an electrical switch actuated responsive to the attraction of said magnet by the skeletal cylinder, further including external magnet means mounted upon the conduit and adapted to exert a magnetic attraction upon the skeletal cylinder in the rest position of the skeletal cylinder, the attraction exerted by said external magnet means being of a value sufficient to be overcome by pressure of fluid against the skeletal cylinder so as to ultimately free the skeletal cylinder for the attraction of the external magnet means and permit the skeletal cylinder to shift to its use position under the pressure of the fluid passing through the conduit.

13. A magnetic flow switch as in claim 12 wherein the external magnet means is in the form of a sleeve-like, permanent magnet clamped to the conduit in any of a plurality of selected positions longitudinally of the conduit.

14. A magnetic flow switch as in claim 12 wherein the external magnet means comprises a plurality of bar magnets clamped to the conduit at any of a plurality of selective positions taken longitudinally of the conduit.

15. A magnetic flow switch comprising:

(a) a pressure fluid conduit;

(b) a skeletal cylinder of a magnetically attractive material comprising ring portions connected by arms defining openings therebetween slidable within the conduit and adapted to be slidably shifted therein from a rest position to a use position by pressure fluid flowing within the conduit;

(c) a magnet and switch assembly mounted on the conduit and including a magnet attracted by the cylinder when the cylinder reaches its use position, and an electrical switch actuated responsive to attraction of said magnet by the cylinder; and (d) a plunger within the conduit against which pressure is exerted by fluid passing through the conduit, said plunger being shiftable within the conduit by the pressure of said fluid flow, to engage the cylinder and bias the cylinder to its use position, wherein the cylinder is of a larger diameter than the plunger and is received in an enlarged-diameter fluid bypass portion of the conduit extending from a portion of the conduit receiving the plunger.

16. A magnetic flow switch as in claim 15 wherein the plunger has a solid cylinder-contacting top and a peripheral wall formed with openings for flow of fluid into the enlarged-diameter portion of the conduit.

* * * * *